United States Patent [19]

Shen

[11] 4,394,249

[45] Jul. 19, 1983

[54] CATALYTIC DEWAXING PROCESS

[75] Inventor: Roderick C. Shen, Belle Mead, N.J.

[73] Assignee: Mobil Oil Corporation, New York, N.Y.

[21] Appl. No.: 289,026

[22] Filed: Aug. 3, 1981

[51] Int. Cl.[3] ..... C10G 47/16

[52] U.S. Cl. ..... 208/89; 208/59; 208/111

[58] Field of Search ..... 208/58, 89, 59, 61, 208/210, 213

[56] References Cited

U.S. PATENT DOCUMENTS

| | | | |
|---|---|---|---|
| 3,227,609 | 1/1966 | Wilson, Jr. et al. | 208/211 X |
| 3,267,020 | 8/1966 | Wilson, Jr. et al. | 208/28 |
| 3,285,848 | 11/1966 | Donaldson et al. | 208/110 |
| 3,520,796 | 7/1970 | Murphy, Jr. et al. | 208/33 |
| 3,539,495 | 11/1970 | Egan | 208/59 |
| 3,617,475 | 11/1971 | Offutt et al. | 208/33 |
| 3,654,128 | 4/1972 | Woodle | 208/33 |
| 3,684,684 | 8/1972 | Coleman et al. | 208/28 |
| 3,700,585 | 10/1972 | Chen et al. | 208/111 |
| 3,702,817 | 11/1972 | Cummins et al. | 208/87 |
| 4,057,488 | 11/1977 | Montagna et al. | 208/89 |
| 4,085,036 | 4/1978 | Murphy, Jr. et al. | 208/212 |
| 4,153,540 | 5/1979 | Gorring et al. | 208/89 |
| 4,210,521 | 7/1980 | Gorring et al. | 208/89 |

*Primary Examiner*—Delbert E. Gantz
*Assistant Examiner*—G. E. Schmitkons
*Attorney, Agent, or Firm*—Charles A. Huggett; Michael G. Gilman; Stanislaus Aksman

[57] ABSTRACT

A hydrocarbon feedstock is desulfurized in a conventional hydrodesulfurization process unit (HDS), and then conducted into a catalytic dewaxing process unit (DDW). The cascading relationship of the HDS/DDW units enables the operator of the plant to recover a substantial portion of thermal energy from a number of process streams and decreases the size of the compressor required in the plant.

27 Claims, 1 Drawing Figure

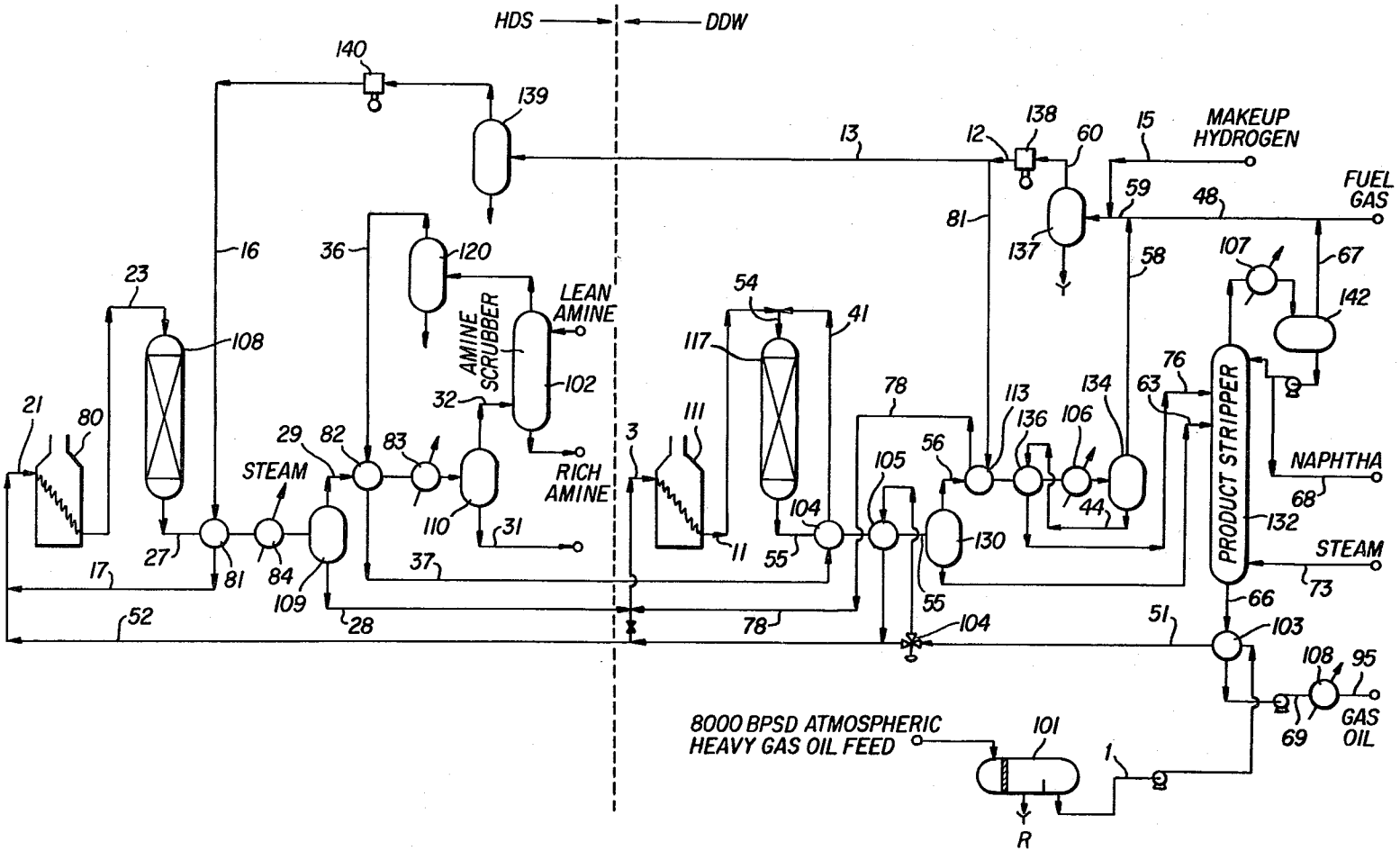
FUEL GAS
MAKEUP HYDROGEN
NAPHTHA
STEAM
GAS OIL
PRODUCT STRIPPER
8000 BPSD ATMOSPHERIC HEAVY GAS OIL FEED
DDW
HDS
LEAN AMINE
RICH AMINE
AMINE SCRUBBER
STEAM

CATALYTIC DEWAXING PROCESS

BACKGROUND OF THE INVENTION

1. Field of the Invention

This invention relates to an improved catalytic process of dewaxing and desulfurization of gas oils.

2. Discussion of Prior Art

Catalytic dewaxing of high-pour gas oils to low pour No. 2 fuel over a shape-selective zeolite catalyst of the ZSM-5 family which selectively cracks long-chain normal paraffins, slightly-branched isoparaffins and long-chain cycloparaffins is known in the art (e.g., U.S. Pat. Nos. 3,700,585 and its reissue, Re. 28,398, the entire contents of both of which are incorporated herein by reference). The catalytic dewaxing process disclosed in these patents (also known as Mobil Distillate Dewaxing or Distillate Dewaxing, MDDW and DDW, respectively), is usually followed by a conventional hydrodesulfurization process (HDS) to remove substantially all sulfur from the product of the catalytic dewaxing process. The conventional hydrodesulfurization process is usually already present in a refinery; thus, the new catalytic dewaxing process is incorporated into the refinery operations upstream of the HDS process.

Prior to the development of the catalytic dewaxing process, high pour point gas oils were dewaxed by a conventional solvent dewaxing treatment. Although solvent dewaxing was also usually followed by the HDS process, it has been suggested in prior art to first subject the sulfur-containing high pour gas oils to the HDS process and then to the conventional solvent dewaxing process (see, e.g., U.S. patents to Murphy et al., U.S. Pat. No. 3,520,796 and to Offutt et al., U.S. Pat. No. 3,617,475). Murphy et al. claim that this sequence of operations reduced pour point of the product, and Offutt et al. that it produces a product with better hazing characteristics. However, in the process sequence of both Offutt et al. and Murphy, Jr. et al., the two unit operations (the HDS and the dewaxer) are used as physically and conceptually separate units connected only by the oil base stock entering the HDS unit and by the desulfurized product of the HDS unit entering the dewaxer. The only advantages claimed by Offutt et al and by Murphy, Jr., et al. relate to the final product qualities.

In contrast, it has now been discovered that substantial process and cost advantages can be attained if the conventional HDS unit is followed by the catalytic distillate dewaxing process unit (hereinafter DDW), and if a number of process streams flow between the units to maximize the utilization of compression and heat exchange capabilites between the two units.

BRIEF DESCRIPTION OF THE FIGURE

The FIGURE is a flow chart of one exemplary embodiment of the invention.

SUMMARY OF THE INVENTION

The hydrodesulfurization process unit (HDS) is arranged in a cascading relationship with the catalytic distillate dewaxing process unit (DDW), so that a smaller booster compressor between the HDS and the DDW units is required than would have been needed if the dewaxing unit were placed upstream of the HDS unit. In addition, the cascading operation also reduces or eliminates coking in the DDW charge heater. The HDS and the DDW unit operations are completely integrated to recover a substantial amount of thermal energy from various process streams and transfer it from one unit operation to another.

DETAILED DESCRIPTION OF THE INVENTION

The hydrodesulfurization process unit used in the present invention is any conventionally known hydrodesulfurization process unit (HDS) used in the art. For example, the catalyst used in the process could be any conventional hydrodesulfurization catalyst, such as a catalyst comprising a Group VA (chromium, molybdenum, or tungsten) metal, and a Group VIIIA metal, or their oxides or sulfides. The HDS process is conducted with the catalyst under hydroprocessing conditions comprising: a hydrogen pressure of about 40 atmospheres (about 600 psig) to about 205 atmospheres (about 3000 psig), preferably about 103 atmospheres (about 1500 psig) to about 171 atmospheres (2500 psig); a temperature of about 345° C. (about 650° F.) to about 455° C. (about 850° F.), preferably 370° C. (about 700° F.) to about 440° C. (about 820° F.); a liquid hourly space velocity of 0.1 to 6.0, preferably 0.4 to 4.0 The hydrogen gas used during the process of hydrodesulfurization is circulated through the hydrodesulfurization reactor at the rate of between about 1000 and 15,000 scf/bbl of feed and preferably between about 1000 and 8000 scf/bbl. The hydrogen purity may vary from about 60 to 100%. If the hydrogen is recycled, as is customary, it is desirable to provide means of bleeding off a portion of the recycled gas and to add makeup hydrogen in order to maintain the hydrogen purity within the specified range. The recycled gas is usually washed with a chemical absorbent for hydrogen sulfide or otherwise treated in a known manner to reduce the hydrogen sulfide content thereof prior to recycling. The HDS process removes about 50% to about 99.5% by weight of the sulfur originally present in the feedstock. Feedstocks which can be used in the process are high-pour gas oils, such as straight run atmospheric and vacuum gas oils and cracked gas oils. Products of the process include: gas oils, naphthas and light ends.

In the present invention, the hydrogen makeup stream is preferably added to the catalytic dewaxing unit operation of the process and a portion thereof is subsequently recycled, after compression, to the HDS unit operation. Only a portion, e.g., between 40% and 50%, of the hydrogen stream introduced into the catalytic dewaxing unit is subsequently recycled to the HDS unit, depending on the relative amounts of hydrogen required for the two units. Accordingly, the size of the booster compressor required to compress the makeup recycle gases is reduced because only half or less of the total stream of the recycle gases must be compressed to the higher pressure under which the HDS process is operating. In contrast, in an operation wherein the catalytic dewaxing process precedes the HDS process, the size of the compressor unit would have been at least double the size of that in the present process since the entire hydrogen makeup recycle stream would have to be compressed to the higher pressure of the HDS unit operation.

In addition, a number of high temperature process streams in the dewaxing process unit and in the desulfurization process unit are passed through various heat exchanging means with cooler process streams from one or both process units to extract the thermal energy from the high temperature streams.

The dewaxing process unit is otherwise operated in a conventional manner of other catalytic dewaxing units (e.g., as that disclosed in U.S. Pat. No. 3,700,585). Thus, the catalyst used in the dewaxing unit operation is the catalyst of the ZSM-5 type (which includes the following specific zeolites: ZSM-5, ZSM-11, ZSM-23, ZSM-38 and ZSM-43), preferably ZSM-5, and the conditions of the catalytic dewaxing are those of cracking or hydrocracking operations. Typical cracking process conditions include: a liquid hourly space velocity between about 0.5 and 200, a temperature between about 550° F. and about 1100° F., and a pressure between about subatmospheric and several hundred atmospheres. Conversely, typical hydrocracking operation conditions include: temperatures of between 650° F. and 1000° F., a pressure between about 100 and 3000 p.s.i.g., and preferably between about 200 and 700 p.s.i.g., liquid hourly space velocity of between about 0.1 and about 10, preferably between 0.5 and about 4, and the hydrogen to hydrocarbon mole ratio of between about 1 and about 20, preferably between about 4.0 and about 12. The feed introduced into the dewaxing unit reactor is modified by recycling a substantial amount of gaseous components from the low temperature separator into the catalytic dewaxing reactor. The amount of gaseous components from the low temperature separator introduced into the catalytic reactor is such that the gases constitute about 50% to about 100%, preferably 80% to 100% of the total feed in the catalytic reactor. Accordingly, higher operating temperatures can be sustained in the catalytic reactor without a substantial increase in the amount of coke produced therein. Thus, the catalytic dewaxing reactor can be operated at a temperature of about 500° F. to 850° F. under cracking process conditions, or at a temperature of about 500° F. to about 1000° F. at hydrocracking process conditions with virtually no increase in coke production, as compared to the amount of coke produced at conventional cracking and hydrocracking conditions used in prior art catalytic dewaxing operations. Increased temperature of the catalytic dewaxing reactor produces a number of high temperature process streams exiting the reactor which, in turn, enables the operator of the process to recover a substantially higher proportion of thermal energy from such high temperature process streams in appropriate heat exchanging operations. In this connection, the gaseous components recycled into the catalytic dewaxing reactor are comprised of: vapor from HDS low temperature separator and, that from DDW low temperature separator, as well as make-up hydrogen.

The process will now be described in conjunction with a process flow chart of one embodiment thereof illustrated in the FIGURE.

The feedstock (atmospheric heavy gas oil) is received either from storage at the plant or through any other conventional transfer means, e.g., a direct pipeline from an unrelated unit operation in the plant or elsewhere, and is conducted at the rate of 8000 barrels per standard day (BPSD) to the feed surge and water knockout drum 101. The drum 101 is of a conventional consustion known in the art and it removes substantially all of the water, if any, present in the feedstock as a residue stream R.

The feed stream, now substantially free of water (containing not more than 300 ppm by weight of water), is pumped from the drum 101 into a heat exchanger 103, then through a 3-way valve 104, and subsequently through a heat exchanger 105 into a hydrodesulfurization charge heater 80. The heat exchanger 103 extracts heat from a stream 66 (a product stripper bottoms), while the heat exchanger 105 extracts heat from the stream 55, which is a stream obtained from the dewaxing catalytic reactor effluent. Before entering the HDS heater 80, the feed is mixed in line with preheated HDS recycle gas (stream 17). On the basis of the aforementioned feedstock flow rate, the heat exchanger 103 transfers about 14 million BTU's per hour (BTU/hr.) to the feed stream 51; the heat exchanger 105 transfers about 23 million BTU/hr, thus increasing the temperature of the stream from about 360° F. (the temperature of the stream 51 immediately before the 3-way valve 104) to about 700° F. (the temperature of stream 52 immediately after exiting the heat exchanger 105). The temperature of stream 17 (the preheated HDS recycle gas stream 17) is about 630° F. Accordingly, after this stream is mixed with the stream 52, the temperature of the combined stream is about 640° F., as that combined stream enters the HDS charge heater 80. In the charge heater 80, about 4 million BTU/hr are transferred to the combined oil feed and HDS recycle gas (stream 21). The charge heater 80 is also of a conventional construction, such as box-type with vertical tubes. The heated stream 23 exiting the charge heater has a temperature of about 700° F. It is then conducted to a downflow fixed bed reactor 108 operating at the pressure of about 700 p.s.i.g. The reactor 108 is also of a conventional construction for hydrodesulfurization units well known in the art.

The HDS reactor effluent, stream 27, has a temperature of about 690° F. to about 740° F. and it is used to preheat its recycle gas in the heat exchanger 81 so that the stream 26 exiting the heat exchanger has a temperature of about 630° F. This stream is then cooled in the low pressure steam boiler 84 to the temperature at which the high temperature separator 109 is operated. The heat exchanger 84 extracts about 7.0 million BTU/hr from the stream 26. The cooled stream 26 is now conducted to the high temperature separator 109, operating at about 550° F. and about 630 p.s.i.g. The separater 109 separates the stream 26 into a stream 28, a liquid flowing at the rate of about 7700 BPSD, and a stream 29, a gaseous stream, comprising essentially hydrogen and lower hydrocarbons, including alkanes and alkenes of $C_1$ to $C_4$, flowing at the rate of about 10.0 million SCFD.

The liquid stream 28 is combined with a preheated recycle gas (stream 78) into a stream 3 which is introduced into the catalytic dewaxing process charge heater 111. The stream 3 has a temperature of about 520° F. The catalytic dewaxing process charge heater 111 operates at about 620 p.s.i.g. to add about 30 million BTU/hr of heat to the stream 3. The heated stream 11 exiting the heater 111 has a temperature of about 820° F.

The HDS high temperature separator vapor, stream 29, is used to preheat low temperatures separator vapor after it has gone through an amine scrubber 102 to remove hydrogen sulfide and ammonia. The high temperature separator vapor is further cooled to the temperature at which the low temperature separator 110 operates. Thus, the high temperature separator vapor stream 29 is conducted to the heat exchanger 82, wherein its temperature is decreased to about 380° F., and then to a water cooler 83, wherein its temperature is reduced to about 100° F. The heat exchanger 83 removes about 4.0 million BTU/hr from the stream 29.

The low temperature separator 110 operates at about 100° F. and about 600 p.s.i.g. The HDS low temperature separator vapor (stream 32) is charged to an amine scrubber 102, while the liquid stream 31, an unstabilized naphtha, can be charged to any conventional stabilizer or stripper. The flow rate of the stream 31 is about 500 BPSD.

The HDS low temperature separator vapor is conducted to a vessel 120 which is a knock-out drum, to remove any entrained amines in the vapor. From the vessel 120, the vapor is conducted through a heat exchanger 82, as discussed above, and then to a heat exchanger 104, where it is further heated by the catalytic dewaxing reactor bottoms effluent, stream 55. After leaving the heat exchanger 104 (sized at about 3.5 million BTU/hr), the vapor has a temperature of about 730° F. (stream 41). Stream 41 is then combined in-line with the heated stream 11 from the catalytic dewaxing charge heater 111, and is then conducted to the catalytic dewaxing reactor 117. The stream 54 entering the reactor 117 has a temperature of about 800° F., and it is introduced into the reactor 117 at about 600 p.s.i.g. The reactor 117 is of a conventional construction used in prior art for such catalytic dewaxing unit operations. Thus, the reactor 117 is filled with a ZSM-5 type catalyst, and equipped with an appropriate distribution system for mixed phase (vapor and liquid) feeds.

Stream 54 is introduced into the reactor 117 at the rate of 7700 BPSD. Stream 41 flows at the rate of about 9.0 million SCFD.

HDS high temperature separator liquid, stream 28, is mixed in-line with preheated recycle gas (stream 78) from the catalytic dewaxing unit fefore entering the catalytic dewaxing unit charge heater 111. The heater 111 is sized at about 30 million BTU/hr. The temperature of stream 11 exiting the heater is about 820° F. Conversely, the temperature of the combined reactor charge (stream 3) before the introduction thereof into the heater 111 is about 520° F.

The relative pressure levels of HDS low temperature separator vapor and the catalytic dewaxing reactor dictate that separator vapor cannot be charged through the heater 111 without a booster compressor. Therefore, it is preheated in the heat exchanger 104 (sized at about 3.5 million BTU/hr) to about 730° F.

The liquid/vapor mixture heated in the catalytic dewaxing unit charge heater must obtain high enough temperature in order to produce a reactor charge having a temperature of about 800° F. at the end of the operating cycle. At the same time, however, the temperature in the charge heater is limited due to the tendency of the heated stock to form coke in the heater.

The tendency to form coke in the heater is either diminished or almost completely eliminated by supplying a relatively large volume of gaseous components (recycle gas-stream 78) into the heater.

The catalytic dewaxing unit reactor effluent (stream 55) is used to heat HDS low temperature separator vapor (stream 37) in the heat exchanger 104, and then is also used to preheat gas oil charge in the heat exchanger 105. The heat exchanger 105 is controlled by means of a cold feed bypass to maintain a constant temperature (500° F. to 600° F.) of the high temperature separator 130.

The liquid (stream 63) from the high temperature separator 130 is charged directly to product stripper 132. The vapor stream 56 from the high temperature separator 130 is utilized to preheat DDW recycle gas in the heat exchanger 113, which lowers the temperature of the vapor stream to about 430° F. The vapor stream is then conducted to a heat exchanger 106 wherein it is cooled by liquid stream 44, obtained from the low temperature DDW separator 134, to about 340° F., and it is subsequently cooled in a heat exchanger 106 to about 100° F. The heat exchanger 106 extracts about 10 million BTU/hr from the vapor stream, while the heat exchanger 136 is sized to about 4.0 million BTU/hr. The low temperature separator 134 operates at about 100° F. and about 470 p.s.i.g.

The heated low temperature separator liquid, stream 76, is charged to the product stripper 132. If necessary, low temperature separator vapor, stream 58, is charged to an amine scrubber to remove hydrogen sulfide and ammonia. After the optional scrubber, part of the vapor is sent to fuel gas system (stream 48) at the rate of about 1,800,000 standard cubic feet per day (SCFD), and the remainder of the vapor is recycled through a compressor knock-out drum 137 into the HDS unit operation and the DDW unit operation.

Hydrogen makeup, stream 15, is added at the rate of 2,000,000 SCFD to the DDW recycle gas stream 59 to meet the process requirements for both HDS and DDW units. The combined stream of the hydrogen makeup and the recycle gas is conducted to a compressor knock out drum 137, wherein liquid is removed, and it then is conducted into a compressor unit 138 where its pressure is increased to about 650 p.s.i.g. The compressor 138 is used only to raise the pressure for the DDW unit. A portion therefor of the compressed gas stream 81 (about 50%–60%) is recycled to the DDW unit, while the rest, stream 13 (about 40%–50%), is further compressed by compressor 140 to about 740 p.s.i.g., the level required for the HDS unit operation. Knock-out drum 139 removes any liquids which may be present in the stream 13. Consequently, the amount of compression required for the entire HDS/DDW cascade process scheme is reduced, since only a portion of the recycle gas (about 40% to 50%) is compressed to the compression level required by the HDS unit operation.

Both the high temperature DDW separator liquid stream 63, and the heated DDW low temperature separator liquid, stream 76, are charged to the product stripper 132. The product stripper is of a conventional construction, comprising about 20 trays. The stripper is provided with an overhead condenser 107 which removes about 8.0 million BTU/hr of heat, and with an accumulator 142, which operates at about 100° F. and 85 p.s.i.g. A steam stream 73 is injected into the bottom of the stripper. Stream 73 has a temperature of about 550° F. and a pressure of about 180 p.s.i.g. Overhead vapor (stream 67 flowing at the rate of about 400,000 SCFD), if necessary, is charged to an amine unit to remove hydrogen sulfide and ammonia, and finally to a fuel gas system.

Unstabilized naphtha is produced as overhead liquid product stream 68 at the rate of about 1300 BPSD and it is charged to a stabilizer. Water is drained from the boot of the accumulator 142 as stream 74 and is sent to the sour water system. The dewaxed product is withdrawn from the bottom of the stripper as the stream 66 at about 480° F. This stream is first used to preheat the feedstock in the heat exchanger 103 and it is then further cooled in a heat exchanger 108° to about 110° F.

The heat exchanger 108 removes about 3.5 million BTU/hr from the stream 69, a cooled stream 66.

It will be apparent to those skilled in the art that the above example can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. A process for dewaxing at least one petroleum feedstock comprising:

hydrodesulfurizing the feedstock, thereby obtaining a substantially sulfur-free hydrocarbon material;

separating the hydrocarbon material into a gaseous fraction and a liquid fraction;

conducting the liquid fraction directly into a heater of a catalytic dewaxing unit and subsequently into the catalytic dewaxing unit, wherein it is contacted with a highly siliceous zeolite ZSM-5 type porous crystalline material, and conducting an effluent from the catalytic dewaxing unit to a first heat exchanging means;

conducting the gasous fraction into the first heat exchanging means, wherein the gaseous fraction is preheated by the catalytic dewaxing unit effluent; and conducting the thus-obtained preheated gaseous fraction into the catalytic dewaxing unit.

2. A process according to claim 1 wherein the petroleum feedstock has a boiling point of at least 350° F.

3. A process according to claim 2 wherein the highly siliceous porous crystalline material is ZSM-5.

4. A process according to claim 2 wherein a make-up hydrogen stream is introduced into the process downstream of the point of contacting the desulfurized feedstock with the highly siliceous porous crystalline material of the zeolite ZSM-5 type.

5. A process according to claim 4 wherein the hydrodesulfurizing step is conducted at a temperature of 650° F. to 850° F. and at a pressure of 600 to 3000 p.s.i.g., and the step of contacting the desulfurized feedstock with the crystalline material, conducted under cracking process conditions, is carried out at a temperature of about 550° F. to 1000° F., at a pressure of about 100 to about 3000 p.s.i.g., and at liquid hourly space velocity of 0.5 to 200.

6. A process according to claim 4 wherein the hydrodesulfurizing step is conducted at a temperature of 650° F. to 850° F. and at a pressure of 600 to 3000 p.s.i.g., and the step of contacting the desulfurized feedstock with the crystalline material, conducted under hydrocracking process conditions, is carried out at a temperature of about 650° F. to about 1000° F., a pressure of about 100 p.s.i.g. to about 3000 p.s.i.g., liquid hourly space velocity of about 0.1 to about 10, and hydrogen to hydrocarbon mole ratio of about 1 to about 20.

7. A process according to claim 6 wherein at least 40% by volume of the total hydrogen stream is conducted from the catalytic dewaxing unit to the hydrodesulfurizing unit.

8. A process according to claim 7 wherein 50% by volume of the total hydrogen stream is conducted from the catalytic dewaxing step to the hydrodesulfurization step.

9. A process according to claim 5 wherein the gaseous fraction, prior to its introduction into the first heat exchanging means, is passed through an amine scrubber to remove hydrogen sulfide and ammonia therefrom.

10. A process according to claim 9 wherein the catalytic dewaxing unit effluent is conducted to a second heat exchanging means to preheat the petroleum feedstock, and subsequently to a high pressure separator which separates the catalytic dewaxing unit effluent into a high pressure separator gas fraction and a high pressure separator liquid fraction.

11. A process according to claim 10 wherein the high pressure separator liquid fraction is conducted to a product stripper means which produces a fuel gas fraction, a naphtha fraction, a gas oil fraction and a dewaxed product fraction.

12. A process according to claim 11 wherein the dewaxed product fraction is passed to a third heat exchanging means to preheat the petroleum feedstock to a temperature intermediate between the initial petroleum feedstock temperature and the temperature it is preheated to in the second heat exchanging means.

13. A process according to claim 12 wherein gases constitute about 50% to about 100% of the total feed of the catalytic dewaxing unit.

14. A process according to claim 13 wherein gases constitute about 80% to 100% of the total feed of the catalytic dewaxing unit.

15. In a catalytic process for dewaxing at least on petroleum feedstock comprising contacting the petroleum feedstock with a highly siliceous ZSM-5 type zeolite porous crystalline material at a temperature of about 550° F. to about 1100° F. and at a pressure of about 15 psig to about 3000 psig, the improvement which comprises desulfurizing the petroleum feedstock prior to the introduction thereof into the catalytic dewaxing process so that the hydrocarbon effluent of the desulfurization step contains less than about 3% by weight of sulfur;

separating the hydrocarbon effluent into a gaseous fraction and a liquid fraction;

conducting the liquid fraction directly into a heater of a catalytic dewaxing unit and subsequently into the catalytic dewaxing unit, wherein it is contacted with a highly siliceous zeolite ZSM-5 type porous crystalline material, and conducting an effluent from the catalytic dewaxing unit to a heat exchanging means;

conducting the gaseous fraction into the first heat exchanging means, wherein the gaseous fraction is preheated by the catalytic dewaxing unit effluent; and conducting the thus-obtained preheated gaseous fraction into the catalytic dewaxing unit.

16. A process according to claim 15 wherein the petroleum feedstock is desulfurized by contacting the feedstock with a hydrodesulfurization catalyst and hydrogen at hydrogen pressure of about 1000 to about 3000 p.s.i.g, at a temperature of about 650° F. to 850° F., thereby removing about 50% to about 99.5% by weight of sulfur originally present in the feedstock.

17. A process according to claim 16 wherein the feedstock subjected to desulfurization is a high pour gas oil.

18. A process according to claim 15 wherein the gaseous fraction, prior to its introduction into the first heat exchanging means, is passed through an amine scrubber to remove hydrogen sulfide and ammonia therefrom.

19. A process according to claim 16 wherein the gaseous fraction, prior to its introduction into the first heat exchanging means, is passed through an amine scrubber to remove hydrogen sulfide and ammonia therefrom.

20. A process according to claim 18 wherein the catalytic dewaxing unit effluent is conducted to a second heat exchanging means to preheat the petroleum feedstock, and subsequently to a high pressure separator which separates the catalytic dewaxing unit effluent into a high pressure separator gas fraction and a high pressure separator liquid fraction.

21. A process according to claim 20 wherein the high pressure separator liquid fraction is conducted to a product stripper means which produces a fuel gas fraction, a naphtha fraction, a gas oil fraction and a dewaxed product fraction.

22. A process according to claim 21 wherein the dewaxed product fashion is passed to a third heat exchanging means to preheat the petroleum feedstock to a temperature intermediate between the initial petroleum feedstock temperature and the temperature it is preheated to in the second heat exchanging means.

23. A process according to claim 19 wherein the catalytic dewaxing unit effluent is conducted to a second heat exchanging means to preheat the petroleum feedstock, and subsequently to a high pressure separator which separates the catalytic dewaxing unit effluent into a high pressure separator gas fraction and a high pressure separator liquid fraction.

24. A process according to claim 23 wherein the high pressure separator liquid fraction is conducted to a product stripper means which produces a fuel gas fraction, a naphtha fraction, a gas oil fraction and a dewaxed product fraction.

25. A process according to claim 24 wherein the dewaxed product fraction is passed to a third heat exchanging means to preheat the petroleum feedstock to a temperature intermediate between the initial petroleum feedstock temperature and the temperature it is preheated to in the second heat exchanging means.

26. A process according to claim 21 wherein gases constitute about 50% to about 100% of the total feed of the catalytic dewaxing unit.

27. A process according to claim 26 wherein gases constitute about 80% to 100% of the total feed of the catalytic dewaxing unit.

* * * * *

UNITED STATES PATENT AND TRADEMARK OFFICE

CERTIFICATE OF CORRECTION

PATENT NO. : 4,394,249

DATED : July 19, 1983

INVENTOR(S) : RODERICK C. SHEN

It is certified that error appears in the above-identified patent and that said Letters Patent is hereby corrected as shown below:

| | |
|---|---|
| Column 2, line 12 | Change "VA" to --VIA--. |
| Column 3, line 62 | Change "consustion" to --construction--. |
| Column 4, line 60 | Change "temperatures" to --temperature--. |
| Column 5, line 35 | Change "fefore" to --before--. |
| Column 6, line 34 | Delete the word "therefor". |
| Column 8, line 28 | Change "on" to --one--. |

Signed and Sealed this

Second Day of October 1984

[SEAL]

*Attest:*

GERALD J. MOSSINGHOFF

*Attesting Officer*

*Commissioner of Patents and Trademarks*